United States Patent [19]

Otto

[11] 4,274,495

[45] Jun. 23, 1981

[54] TOOL BALANCING APPARATUS

[76] Inventor: Günter Otto, Heerweg, 7306 Denkendorf, Fed. Rep. of Germany

[21] Appl. No.: 81,543

[22] Filed: Oct. 3, 1979

[30] Foreign Application Priority Data

Oct. 6, 1978 [DE] Fed. Rep. of Germany ..... 2843727

[51] Int. Cl.[3] ..... E21B 3/00

[52] U.S. Cl. ..... 173/162 R

[58] Field of Search ..... 173/162 R, 32–37; 248/571, 610, 647; 267/137, 124, 126; 92/8–12, 130 B

[56] References Cited

U.S. PATENT DOCUMENTS 2,323,321 7/1943 Futral ..... 267/124

3,647,199 3/1972 Bhutani et al. ..... 267/124

3,966,182 6/1976 Stadelmann ..... 267/124

*Primary Examiner*—Ronald Feldbaum

*Attorney, Agent, or Firm*—Fleit & Jacobson

[57] ABSTRACT

A tool balancing apparatus comprises a spring arrangement for balancing the weight of a tool such as an assembly tool. The spring arrangement is a hydropneumatic piston-cylinder unit whose one end is connected to a suitable mounting means and whose other end, being extensible, carries the tool. The apparatus further includes a bracing means such as a tube or a torsion bar assembly to form a rigid connection between the tool and the mounting means, thereby to carry any forces produced by the tool during operation thereof and to transmit such forces to the mounting means.

40 Claims, 11 Drawing Figures

TOOL BALANCING APPARATUS

BACKGROUND OF THE INVENTION

The invention is concerned with an extensible weight compensating apparatus or balancer for compensating for the weight of a tool such as an assembly tool as may be used for example on an assembly line in a factory.

Weight compensating means, also often referred to as balancers, are used as an assistance in making the work of an operator easier in carrying out production and machining operations involving the use of manually guided tools such as drilling or boring machines, grinding machines, screwing machines such as bolt and screw drivers, spot-welding tongs, riveting hammers, stirring mechanisms and the like. The balancers operate in such a way that a spring such as a coil spring, which is under a prestress corresponding to the weight of the tool, holds in a condition of equilibrium or balance the load of the tool, which thus applies a force to a cable drum by means of cable from which the tool is hung. By hanging the tools on a balancer of this kind, the weight of the tool is virtually nullified. However, with the known balancers, the tools are fully balanced in this way only within a given range of tool movement from the rest position of the tool and thus within a given range of extension of the cable, being the range within which the weight of the tool is in equilibrium with the spring force acting on the cable. Under different conditions in respect of the length of cable extension, the spring force of the mechanical spring alters, and a satisfactory weight balancing action is achieved only within a relatively small range of movement. The known balancers must therefore be adapted to the specific tool which is to be connected thereto and thus balanced thereby. Therefore, for different tools, in particular for tools of different weights, it is necessary to provide a number of balancers which are of different designs which thus provide different spring balancing actions. In addition, the length by which the tool may be extended or displaced from a rest position is also limited, in dependence on the spring used, for the reasons already referred to above. In addition, manually operated tools, for example screwing means, produce forces, in the course of operation, which must be resisted by the muscle power of the operator, when using the known balancers. In this respect therefore, the known balancers do not give full satisfaction in regard to making the work of the tool operator easier.

SUMMARY OF THE INVENTION

An object of the invention is to avoid the disadvantages and shortcomings of the above-discussed constructions.

A further object of the invention is to provide a weight compensating means or balancer for a tool, which is capable of substantially facilitating the work of an operator when handling the tool, in such a way as to provide for uniform weight balancing effects over virtually the entire length of extension movement of the tool.

A further object of the invention is to provide a tool balancer which is capable of absorbing forces produced by the tool in operation thereof.

According to the invention, these and other objects are achieved by a weight compensating means or balancer for a tool, which has a counterbalancing spring means in the form of a hydro-pneumatic piston-cylinder unit. One end of the piston-cylinder unit is mounted to a movable or stationary mounting means, while the tool is provided at the movable or extensible end of the piston-cylinder unit. Forces which originate from or which are produced by the tool in operation thereof are carried by means of a rigid support arrangement or bracing means which can be force-lockingly connected as by clamping to the outer cylinder of the piston-cylinder unit and which form a force-transmitting bridge means which bridges over the piston and the piston rod of the piston-cylinder unit, whereby such forces are not transmitted by way of the unit but instead are transmitted to the stationary or movable mounting means by way of the bridge means.

This arrangement advantageously makes use of the fact that the spring properties of a hydro-pneumatic piston-cylinder unit can be made constant virtually over the entire length of the stroke movement of the piston. In this way, in spite of the balancer having a long extension travel, the weight balancing action remains uniform over the entire extension distance. In addition, any forces which are produced by the tool, which may be for example a torque force, are satisfactorily carried by the rigid suport means which is engaged with the outer cylinder of the piston-cylinder unit, thus resulting in a further substantial improvement for the operator in handling of the tool, apart from the weight balancing action therefor.

The invention further provides that the position in the apparatus, which could most readily break under the application of forces produced by the tool, namely the position at which the piston rod is secured to the tool or to the mounting means, is not put under load. This is achieved by the rigid support means which bridges over this part of the balancer, so that the forces to be transmitted from the tool to the mounting means so-to-speak by-pass the piston-cylinder unit.

In an advantageous embodiment of the invention, the piston-cylinder unit has an inner cylinder which is disposed within an outer cylinder and in which the piston and the piston rod are axially movable, while an axially movable compensating or separating piston is disposed between the inner cylinder and the outer cylinder. The compensating piston divides the space between the inner and the outer cylinders into two chambers, one of which is filled with a hydraulic fluid and is in communication by way of a duct or conduit with a chamber, also oil-filled, which is defined within the inner cylinder by the piston therein. The other chamber in the outer cylinder chamber is filled with a compressed gas, while atmospheric pressure obtains in the other chamber in the inner cylinder, which is delimited by the inner cylinder piston. This arrangement provides a piston-cylinder unit in which the piston rod is interchangeable, by being unscrewed from its piston in the inner cylinder. In this way, piston rods of different diameters can be used in the same piston-cylinder unit, so that the ratio between the internal diameter of the cylinder and the piston rod diameter, and thus the effective piston diameter or area, and thus also the load-carrying force of the balancer, can be easily adjusted. This arrangement also provides for greater ease of maintenance, by virtue inter alia of the removability of the piston rod. Although U.S. Pat. No. 3,326,546 discloses a similar hydropneumatic piston-cylinder unit with an inner cylinder and an outer cylinder, there is no interchangeability therein in respect of the piston rod and thus no possibility of adjustment of the load-carrying capacity of the unit.

In a further embodiment of the invention, with the piston rod being removable from the piston-cylinder unit, the piston rod may be removed from the piston-cylinder unit in conjunction with a piston rod guide means. These arrangements further enhance the possibility of adjustment of the load-carrying capacity of the apparatus.

The above-mentioned rigid support means may be in the form of a clamping or stressing tube which is disposed around the outer cylinder of the piston-cylinder unit, with the outer cylinder being displaceable in the tube in the axial direction, when the tube is not clamped thereto. This arrangement provides for compactness in respect of the individual components of the balancer. The tube may have a circular outer casing which can be brought into force-locking connection with or clamped on to the outer surface of the piston-cylinder arrangement, by means of a clamping collet or chuck arrangement which is for example pneumatically operable. This arrangement makes it possible to withstand the high torque values which may be produced by the tool and which are likely to occur in particular in respect of screw or bolt drivers which are operated in a position of alignment with the axial direction of the balancer, that is to say, generally vertically.

In accordance with a further general arrangement of the invention, instead of being suspended from an overhead carriage, the tool may be carried on a carriage which is movable on the floor or ground, the tool being displaceable in vertical and horizontal directions and being pivotal through 360°, thereby making the tool usable universally, that is to say, in any desired position. The tool is then no longer linked to a rail guide arrangement which is usually overhead, but instead the tool can be disposed at any desired position in an assembly or production area.

In an advantageous embodiment of the invention, the tool and the balancer are so interconnected or operatively interlocked that the tool itself can be set in operation only after all the operating conditions which are necessary for the forces produced by the tool in operation thereof to be satisfactorily carried, have been attained.

The balancer according to the invention may thus be used wherever manually operated tools are employed, virtually eliminating or at least substantially reducing the physical force which the operator must use, in comparison with that required for operating prior-art devices.

DESCRIPTION OF THE PREFERRED EMBODIMENTS

Figure 1:
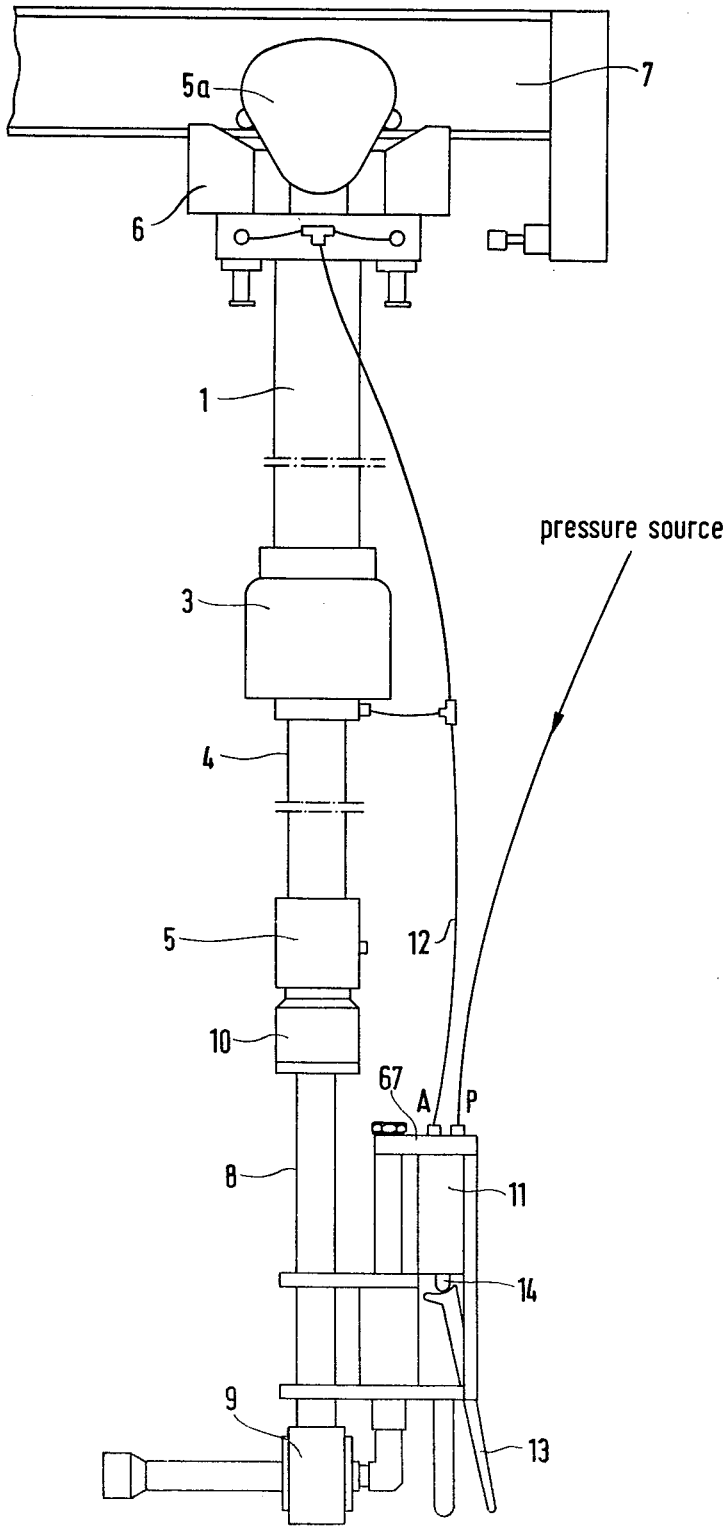
FIG. 1 shows an embodiment of the invention which uses a clamping tube of circular cross-sectional form.

Reference will first be made to FIG. 1 which shows an embodiment of the arrangement of the invention, which comprises a rigid support or bracing means in the form of a clamping tube 1 which is of round or circular cross-section on its outer surface and which can be brought into force-locking engagement with an outer cylinder 4 of a piston-cylinder unit, by means of a clamping chuck or collet arrangement 3. The tube 1 is secured at one end to a mounting means including a rolling carriage 5*a*, for example by screw means (not shown), the carriage 5*a* being movable on a rail 7 secured in an overhead position for example to a ceiling or like structure. The carriage 5*a* has an arresting means in the form of clamping jaws 6 for stopping the carriage on the rail 7. The cylinder 4 can be extended from or retracted into the tube 1, as will become apparent hereinafter, and selectively locked thereto by clamping of the chuck arrangement 3. The unit has an at least substantially linear spring characteristic.

Disposed at the lower end of the outer cylinder 4 is a filling head 5 whose individual components will be described in greater detail hereinafter with reference to FIGS. 4 and 5. A tool 9 is rigidly secured to the outer cylinder 4 of the piston-cylinder unit by way of a fixing rod 8 and by means of a fixed connection as indicated at 10. The tool may be for example a drilling or boring machine, as illustrated, for example more particularly a pneumatically operated borer or drilling machine.

In order for the tool 9 to be brought into its operative position, the outer cylinder 4 of the piston-cylinder unit is pulled downwardly or moved upwardly in the tube 1 until the tool is at the appropriate position for operation thereof. The load or spring forces which act on the tool in this operation remain substantially constant over the entire distance through which the tool is extended downwardly or retracted upwardly, whereby the weight of the tool is substantially constantly balanced throughout the range of movement of the tool.

Before the tool 9 is set in operation, the chuck 3 is actuated to a clamping condition by suitable actuation of a valve 11 connected to a pressure source (not shown) by way of a connection line P, so that the tube 1 is force-lockingly connected to or gripped on to the cylinder 4. The pressure medium from the pressure source (not shown) is passed from pressure medium outlet A of the valve 11 into the chuck 3 by way of pressure conduit 12. Pressure medium is also passed through the conduit 12 to the pneumatically operable arresting means 6 of the carriage 5*a* so that the clamping jaws of the arresting means 6 are applied to the rail 7 so as to lock the carriage 5*a* in position. After actuation of the chuck 3 and the arresting means 6, the tool 9 can then be set in operation, by further actuation of the valve 11 in the same direction as the direction required for operating the chuck 3 and the means 6.

For operation of the valve 11, the valve has a hand lever 13 whereby a valve piston or spool 14 can be moved into the valve in order to actuate the chuck 3 and the means 6 as well as the tool 9. The valve piston or spool 14 will be described in greater detail hereinafter with reference to FIGS. 6 and 7. Chuck 3, means 6 and tool 9 are thus actuated in the sequence in which they have just been named.

Figure 2:
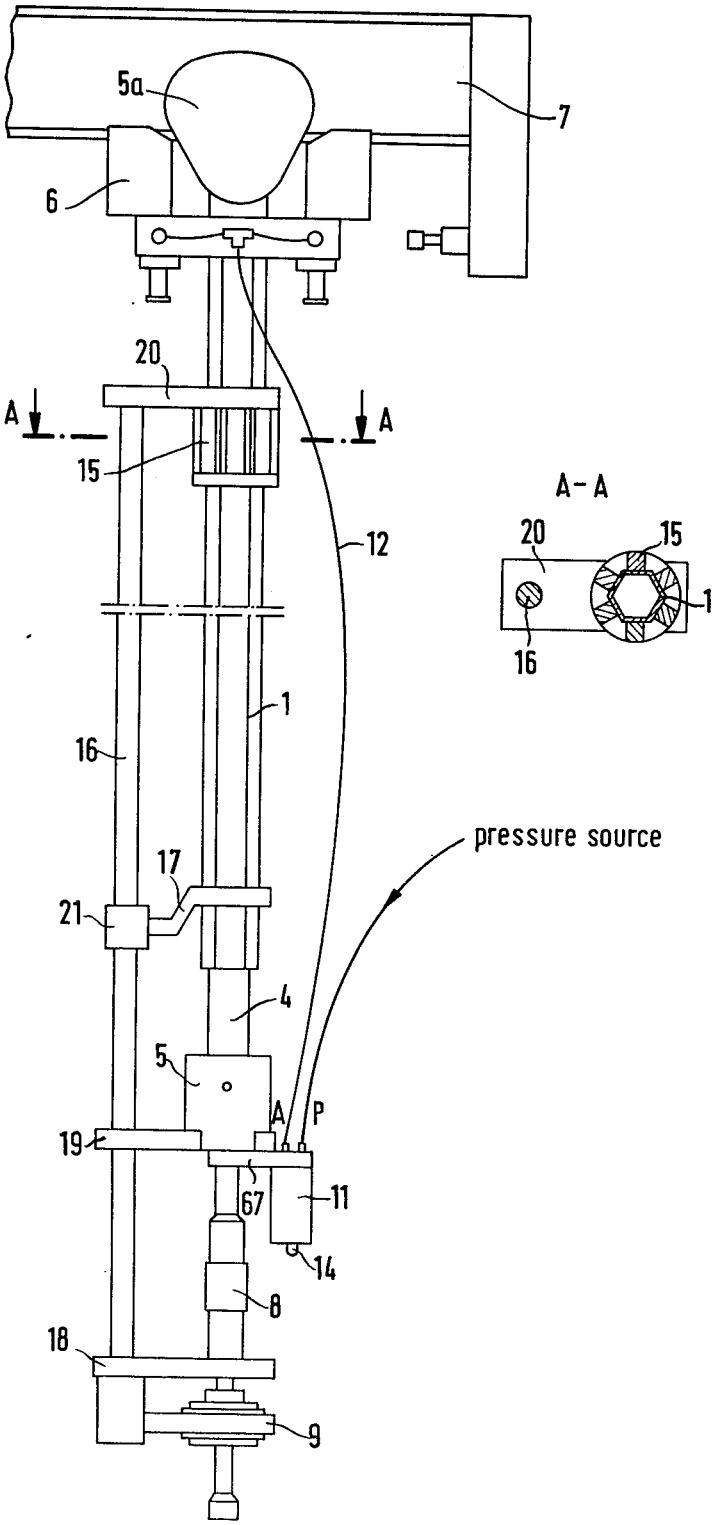
FIG. 2 shows an embodiment of the invention using a tube with a hexagonal cross-sectional form of outer casing.

FIG. 2 shows an arrangement in which the clamping tube 1 is of hexagonal cross-section (see the FIG. 2 sectional view on line A—A). This embodiment is suitable for carrying high torque forces which may be produced by the tool in operation thereof. This is the case in particular when the tool is a bolt or screw driving means which is operated in a vertical position, FIG. 2 showing a tool of this general kind. In FIG. 2, the components which have the same structure or action as corresponding components in FIG. 1 are denoted by the same reference numerals.

Referring therefore more particularly to FIG. 2, a tool 9 is connected to the lower end of a rigid support or bracing means which includes a torsion bar 16, by way of a driver holder plate 18. The torsion bar 16 may be displaced in a vertical direction, together with the tool 9, in order to bring the tool into its working position. When the bar 16 and the tool 9 are thus displaced, displacement also occurs in respect of a force transmission means or sleeve 15 which is connected to the bar 16 and which surrounds the tube 1. The sleeve 15 is of a sleeve-like shape and its inside wall configuration is adapted to the cross-sectional shape of the outer surface of the tube 1, thus in FIG. 2, the inside wall configuration is of a hexagonal cross-section, like the outer surface of the tube 1.

The bar 16 is connected to the sleeve 15 by way of a holding plate 20. When the tool 9 is displaced axially of the tube 1, the outer cylinder 4 is either retracted into the tube 1 or is extended therefrom. When this movement occurs, the bar 16 slides in a guide sleeve 21 which is rigidly secured to the tube 1 by way of a connecting carrier 17. The bar 16 is also connected by way of a connecting carrier 19 to the lower end of the outer cylinder 4 of the piston-cylinder unit, more particularly, the head member 5. The tool 9 is connected to the lower end of the cylinder 4 by way of the connecting carrier 8. The connecting carrier 8 also provides for the supply of pressure medium into the tool 9, whereby the tool is set in operation. However, before the tool 9 is set in operation, the pressure medium is first introduced by way of the pressure conduit 12 into the pneumatically operable arresting means 6 for locking the carriage 5*a* in position, by means of a suitable control action by the valve 11. In this way the carriage 5*a* is locked on the rail 7.

It will be seen that the embodiment of FIG. 2 does not require the additional clamping or locking chuck or collet 3 which is used in the embodiment of FIG. 1. The cylinder 4 and the tube 1 are locked together by way of the bar or rod 16, while forces produced by the tool in operation thereof are transmitted to the tube 1 by way of the bar 16, the carrier plate 20 and the sleeve 15. As in the embodiment of FIG. 1, the tube 1 is secured to the mounting carriage 5*a*. In this way, as also in the embodiment of FIG. 1, the point at which the piston rod of the piston-cylinder unit is secured to the carriage 5*a* is bridged across by the tube 1, so that this position, which represents a weak point in the transmission of force between the carriage and the tool, is not subjected to a heavy loading.

Figure 3:
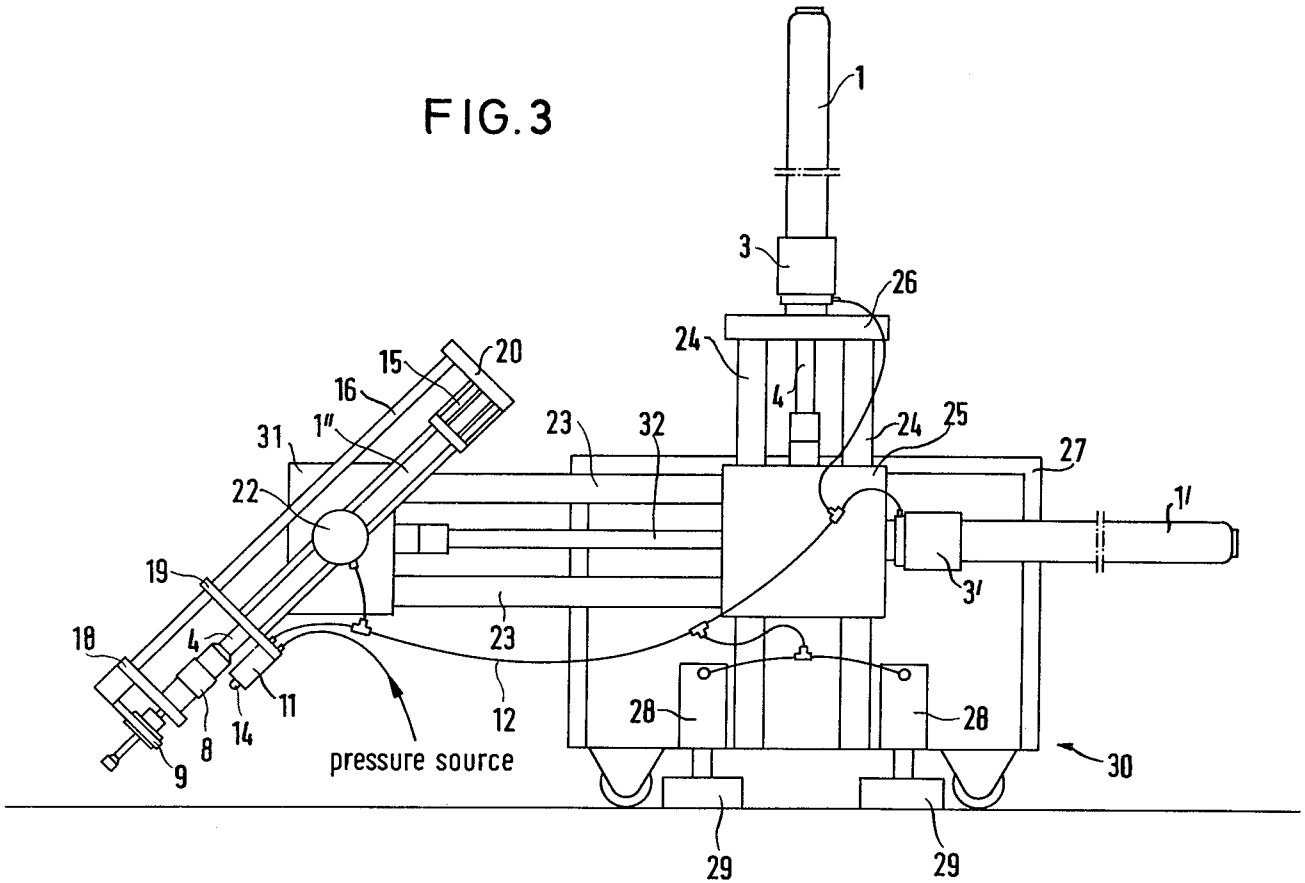
FIG. 3 shows an embodiment of the invention which is movable on a floor or ground surface, on a carriage, and which can be braced on that surface by means of a lifting arrangement.

Reference will now be made to FIG. 3 showing an arrangement in which the tool weight balancing means or balancer is carried on a carriage 30 which is movable on a ground or floor surface. It has been found advantageous for the assembly of FIG. 3 to make use of a weight compensating means construction corresponding to that shown in FIG. 2, that is, comprising a torsion bar arrangement with sleeve thereon. Corresponding components in FIGS. 2 and 3 are thus denoted by the same reference numerals. The weight balancing arrangement comprises a tube 1'' which is mounted on the carriage 30 in such a way that it can be pivoted through 360°. The mounting is formed by a lockable piston-cylinder unit 22 by means of which the tool balancer, together with the tool 9, can be pivoted into the appropriate operating position. The balancer together with the tool 9 may be moved vertically and horizontally by means of a guide arrangement comprising shafts 23 secured to a cross plate or slide 25 and shafts 24 on which the slide 25 is guided. The guide shafts 24 are secured to the carriage, as to a frame assembly 27 thereof. The slide 25 is thus movable vertically on the guide shafts 24, with guide shafts 23 providing for horizontal movement of the balancer with the tool 9. A tube 1 corresponding to tube 1 of FIG. 1, with chuck 3, is supported on the shafts 24 by way of a carrier plate 26, a hydro-pneumatic piston-cylinder unit represented by outer cylinder 4 being disposed in the tube 1. The tube 1 and the piston-cylinder unit therein may be of the same construction as that of FIG. 1, as also may be tube 1' and the piston-cylinder unit which is disposed therein and which is provided for horizontal movement of the mounting block 31 and thus the balancer and the tool 9. The block 31, on which the piston-cylinder unit 22 is carried, is rigidly connected by way of a rigid connecting bar 32 to the outer cylinder of the piston-cylinder unit in the tube 1'. Clamping chucks 3 and 3' respectively are provided to make the force-locking connections between the tube 1 and the tube 1' respectively, and the outer cylinder of the piston-cylinder unit in the respective tube 1, 1'.

The FIG. 3 arrangement includes a valve 11 for controlling locking of the cylinder 22, for actuation of the chucks 3 and 3', and for controlling lifting means 28 whereby the carriage 30 can be braced against and thus lifted from the ground or floor surface, by means of rams or struts 29. The valve 11 may be actuated in the manner shown in connection with the embodiment of FIG. 1. Thus, in FIG. 3 also, when the valve spool 14 is pushed into the valve, the mounting for the cylinder unit 22 is locked and the chucks 3 and 3' are tightened to lock the respective piston-cylinder units in their tubes 1 and 1'. In addition, the carriage 30 is lifted by the lifting means 28 so that the carriage 30 is supported on the ground or floor surface by way of the rams or struts 29. When the valve spool 14 is pushed further into the valve 11, the pneumatically operated tool 9, for example a drilling or boring tool, is set in operation. This arrangement ensures that any forces which are produced by the tool in the FIG. 3 apparatus are safely transmitted to the ground or floor surface and do not therefore have to be withstood by the tool operator.

Figure 4:
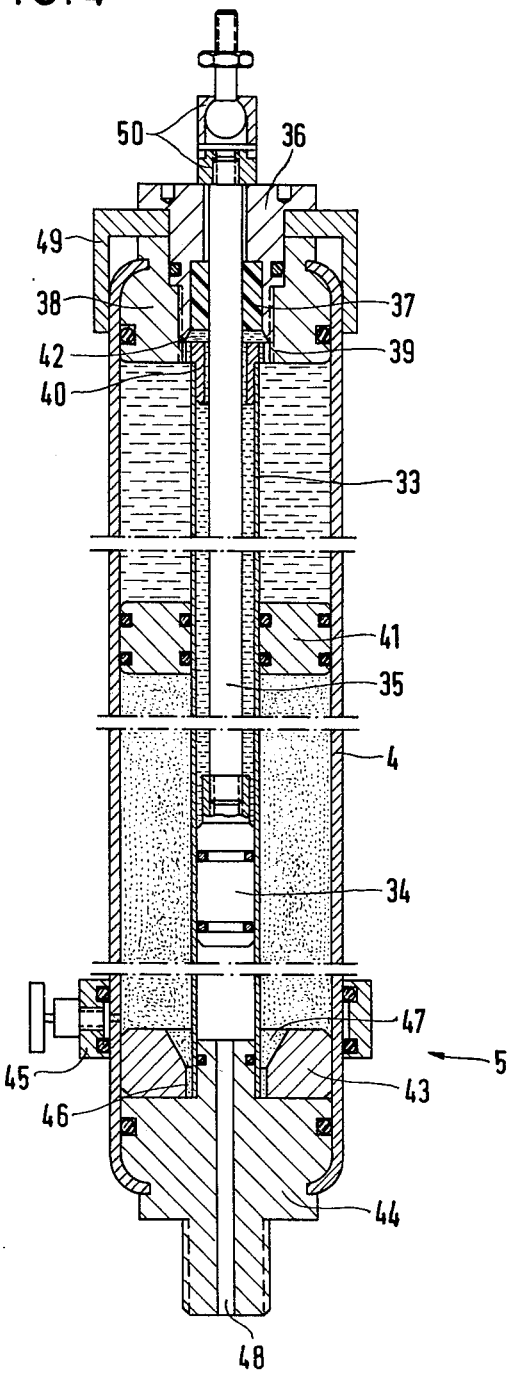
FIG. 4 shows a hydro-pneumatic piston-cylinder unit for use in the FIGS. 1 through 3 embodiments.

FIG. 4 shows an embodiment of the hydro-pneumatic piston-cylinder unit which can be used in the arrangement of the present invention. The piston-cylinder unit comprises an outer cylinder 4 and an inner cylinder 33 fixed therein. A piston 34 is arranged displaceably in the cylinder 33. A piston rod 35 is connected to the piston 34, for example by screw means. The piston rod 35 is guided in a rod guide means or insert 36 provided with a rod seal 37. The guide means 36 is fitted into a connecting member 38 fixed in the outer cylinder 4; the guide means 36 is for example screwed into place in the member 38, a screwthread 29 being provided for this purpose. In this way the piston rod 35 together with the guide means 36 can easily be removed from the cylinder 33. As the piston rod 35 is screwed to the piston 34, the rod can be unscrewed and the piston 34 can thus remain in the cylinder 33. In this way, it is possible to use piston rods of different diameters in piston-cylinder units in which the inner cylinder and the outer cylinder are of the same dimensions, and in particular are of the same diameters. This arrangement therefore makes it possible to vary the relationship between the inside diameter of the inner cylinder 33 and the diameter of the piston rod 35.

In addition, disposed between the rod guide means 36 and the upper end of the cylinder 33 is an abutment neck or collar portion 40 which is at a given spacing with respect to the piston rod 35. The space between the abutment portion 40 and the piston rod 35 forms an overflow passage or duct 42 which thus forms a communication between the chamber above the piston 34 in the cylinder 33, and the chamber between the inner cylinder 33 and the outer cylinder 4, above a separating or compensating piston 41 which divides the cylinder 4 into two chambers. The duct 42 extends horizontally between the seal 37 and the upper part of the abutment portion 40 while between the connecting member 38 and the abutment portion 40, the duct 42 has a further, vertically extending portion which opens into the space between the cylinder 33 and the outer cylinder 4. The space above the piston 33 in the inner cylinder 33, and the space above the piston 41, between the iner cylinder 33 and the outer cylinder 4, which are connected together by way of the overflow duct 42, are filled with a hydraulic fluid, for example oil.

The chamber below the piston 41 between the inner cylinder 33 and the outer cylinder 4 is filled with compressed gas. The pressure gas may be introduced by way of a valve 45.

The cylinder 33 is supported against a bottom member 44 which also closes off and seals the space between the cylinder 33 and the outer cylinder 4 at the lower end thereof. Disposed on the member 44 is an auxiliary ring member 43 having a bore formed by two bore halves or portions 46 and 47, one bore portion 46 being formed at least approximately as a cylindrical bore while the other portion 47 is in the form of a tapered or conical bore 47, to facilitate inserting the cylinder 33 into the operating position shown in FIG. 4.

Atmospheric pressure obtains in the chamber in the cylinder 33 below the piston 34, a vent bore 48 being provided in the member 44 for this purpose.

An abutment neck or collar portion 49 is also secured to the upper part of the outer cylinder 4, for limiting the length of stroke movement of the outer cylinder 4 in the tube 1.

At its upper end, the piston rod 35 is connected by way of a ball joint 50 to a stationary pivot mounting means or to a movable mounting means such as carriage 5*a*. However, any forces which are produced by the tool 9 are not transmitted to the carriage 5*a* by way of the ball joint 50, but instead, as has already been described above in connection with the embodiments of FIGS. 1 through 3, such forces are transmitted by way of the tube 1 which bridges across or by-passes the ball joint 50, so as to provide a by-pass action in respect of the transmission of forces from the piston-cylinder unit to the carriage 1. In this respect therefore, no forces of substantial magnitude are applied to the ball joint 50 during operation of the tool.

Figure 5:
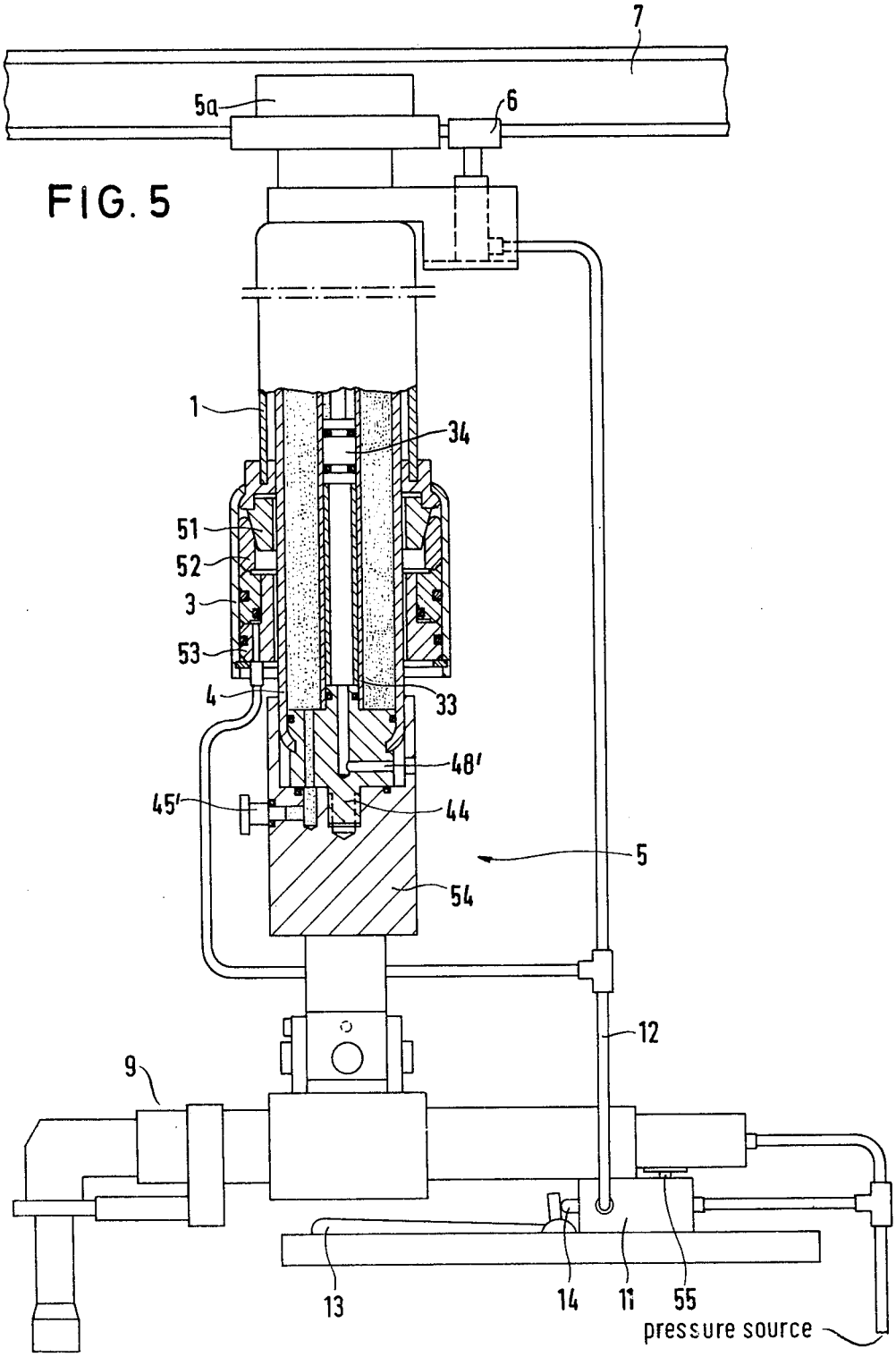
FIG. 5 shows another embodiment of the piston-cylinder unit, showing details of the manner of producing the force-locking connection between the outer cylinder of the piston-cylinder arrangement and the tube.

Reference will now be made to FIG. 5 which shows in greater detail the manner in which the clamping collet or chuck 3 is operative to provide a force-locking connection between the outer cylinder 4 of the piston-cylinder unit and the tube 1. The chuck 3 which is secured to the tube 1 essentially comprises for this purpose a collet or chuck head 51 which can be displaced in the radial direction by axial movement of a pneumatically actuable slider 52. The head 51 and the slider 52 each have tapered or frustoconical surfaces which are in contact with each other and which are so arranged relative to each other that, when a pressure medium is introduced through the pressure conduit 12, the slider 52 is displaced upwardly in FIG. 5 so that the head 51 is pressed against the outer cylinder 4, thereby to make a force-locking connection between cylinder 4 and tube 1. A holding ring 53 is also provided in the collet or chuck 3, for the purposes of guiding and holding the slider 52. The displaceable parts of this assembly are sealed with respect to each other by suitable sealing means (not referenced).

In the construction in FIG. 5, the head 5 is different in construction from the head shown in FIG. 4. However, compressed gas can also be introduced by way of an adjustment valve 45', between the outer cylinder 4 and the inner cylinder 33, below the separating piston (not shown) between the cylinders 4 and 33. The amount of gas introduced can be suitably adjusted. Also disposed in the bottom member 44 is a vent bore 48' by means of which atmospheric pressure can obtain in the cylinder 33 below the piston 34. The bottom member 44 is screwed into a mounting block 54 to which the tool 9 is pivotally connected, the axis of pivotal movement in this arrangement being horizontal.

In this arrangement, the feed of compressed air to the tool 9 is controlled by a switch means 55 which can be actuated by the valve 11 as soon as the valve spool 14 of the valve has been pushed in by a given distance, by means of the manual lever or handle 13; however, before this happens, the arresting means 6 for locking the carriage 5*a* in position and the chuck 3 have been actuated.

Figure 6C:
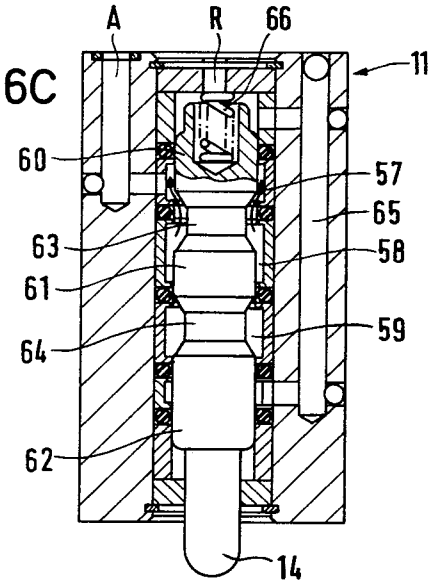
FIGS. 6A through 6C and FIGS. 7A through 7C show a valve control means for controlling pneumatically operable components of the arrangement of the invention.
Figure 6A:
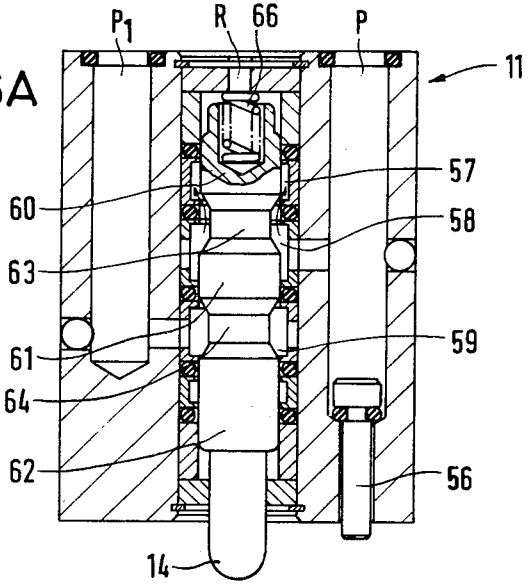
Figure 6B:
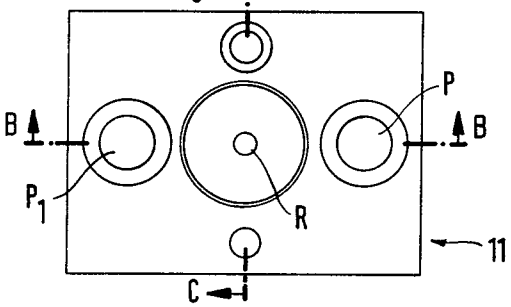

FIGS. 6 and 7 show an embodiment of the valve 11 in greater detail. FIGS. 6A through 6C show the valve alone, FIG. 6A showing the valve in the rest condition being a view in section on B—B in FIG. 6B and FIG. 6B showing the valve in plan view from above, FIG. 6C showing a view in section taken along line C—C in FIG. 6B. The valve comprises a body having a passage or duct P connected to the compressed air source. Disposed at the lower end of the duct P is a water-removal valve 56 for removing condensate water. Three chambers 57, 58 and 59 are disposed in the valve body, one above the other, in the axial direction thereof. The valve spool extends movably through the chambers 57 through 59. The valve spool 14 has lands 60, 61 and 62, with valve grooves 63 and 64 therebetween. The width of the grooves 63 and 64 is such that there is no nozzle or restriction effect when the compressed air is introduced, but instead the compressed air can flow freely therethrough. This means that sufficiently wide through-flow gaps are formed between the grooves 63 and 64 and the walls of the chambers 57 through 59.

Also provided in the valve body is a compressed air outlet duct or conduit $P_1$. The duct $P_1$ is disposed diametrically to the compressed air inlet duct P, with respect to the chambers 57, 58 and 59 in the middle of the valve body. As can be readily seen from FIG. 6C, the valve has a vent duct 65 which is connected to vent bore R by way of a transverse communication (not referenced). The valve also has a further compressed outlet duct A which is disposed diametrically to the vent passage 65, with respect to the spool 14.

As mentioned, FIG. 6A shows the valve spool 14 in the rest position. The valve spool is thus urged into its lowermost position by a compression spring 66. The feed of compressed air from the duct P is blocked with respect to the two discharge ducts $P_1$ and A, by suitable positioning of the lands, more particularly the land 61. As can be seen from FIGS. 6A and 6C, duct $P_1$ is connected to chamber 59, duct $P_1$ is connected to chamber 57 and duct P is connected to chamber 58. The land 61 thus prevents compressed air from passing into the chamber 59 while the valve land 60 prevents compressed air from passing into the chamber 57. If the spool 14 is pushed into the body of the valve by a given amount, to the position shown in FIG. 6A, a communication is formed by way of the groove 63, between the middle chamber 58 and the upper chamber 57. Compressed air can then flow from the duct P which is connected to the compressed air source, by way of the upper chamber 57, into the outlet duct A. As can be seen from the embodiment shown in FIGS. 1 through 3, the duct A is in communication with the means 6 for locking the carriage 5*a*, the chuck 3 or 3', the cylinder unit 22 and the lifting means 28. Therefore, when the valve is in the position shown in FIG. 6C, these devices are actuated.

Figure 7C:
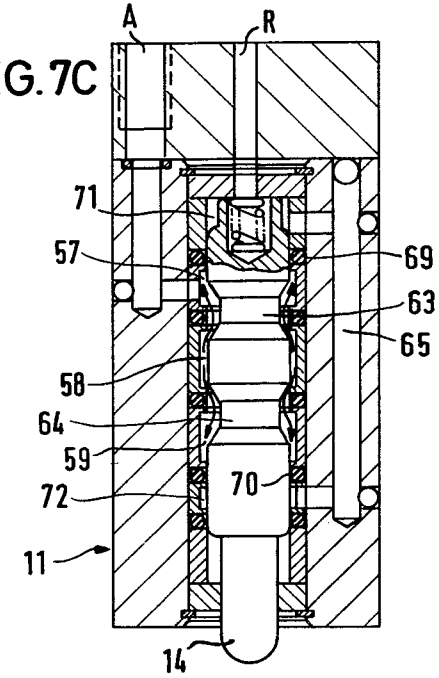
Figure 7A:
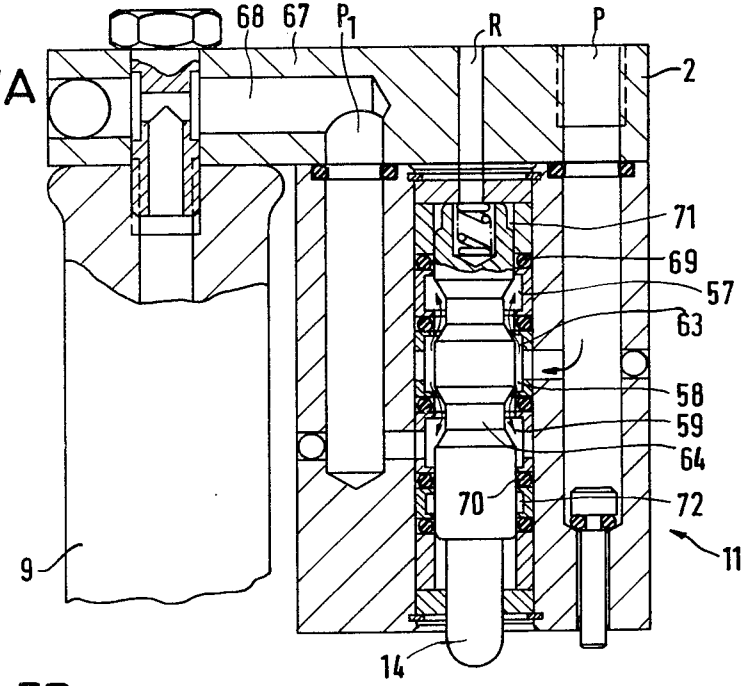
Figure 7B:
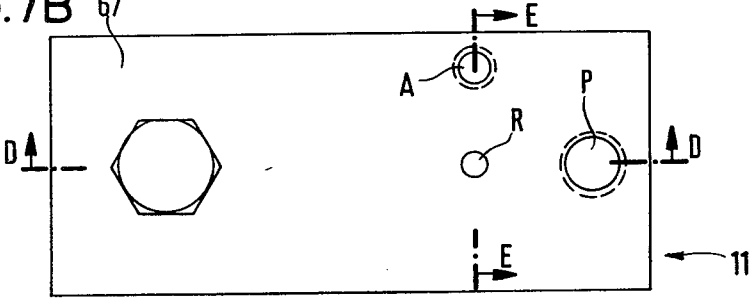

A second operating position of the valve is shown in FIGS. 7A and 7C, FIG. 7A being a view in section on line D—D in FIG. 7B, which in turn is a plan view of the valve with holding plate 67. FIG. 7C shows a view in section on line E—E in FIG. 7B. In this position, the valve spool 14 has been moved into the body of the valve by a further distance so that a communication is formed between the middle chamber 58 and the lower chamber 59, by way of the groove 64. The compressed air can then also flow into the discharge duct P by way of the lower chamber 59, the duct $P_1$ being connected to the pneumatically operable tool 9, as can be seen in particular from FIG. 7A. This ensures that compressed air is first introduced into the conduit 12 from the duct A, and the compressed air which is passed to the tool 9 is subsequently introduced into the second duct $P_1$. The outlet duct $P_1$ is connected by way of a bore 68 in a holding plate 67, to a corresponding compressed air duct in the tool 9.

As can be seen from FIGS. 6 and 7, disposed outside sealing means 69 and 70 which are provided for externally sealing the chambers 57 and 59 are annular chambers 71 and 72 which are in communication with the vent bore R. The chamber 72 is in communication with the vent bore R by way of the vent duct 65, as shown in FIGS. 6C and 7C. Damage to the sealing means 69 and 70 can therefore not have a disadvantageous effect, insofar as the compressed air can then escape by way of the above-mentioned vent ducts and bores. This arrangement thus provides for additional safety in regard to the pneumatic control arrangement.

Various modifications may be made in the above-described arrangements and constructions, without therefore departing from the spirit and scope of the present invention.

I claim:

1. An extensible weight compensating means for balancing the weight of a tool, comprising a spring means for producing a tool weight-balancing force, having a first end mounted to a mounting means and having a second end which is the end capable of extension movement, means at said second end for mounting a tool thereon, and a rigid support means adapted to form a bracing connection operable between said second end of the spring means and said mounting means whereby a force produced by the tool in operation thereof is transmitted to said mounting means by by-passing the spring means.

2. Apparatus as set forth in claim 1 wherein said spring means has the form of a hydro-pneumatic piston cylinder means and said support means is adapted for gripping engagement with the outside surface of the cylinder of said piston-cylinder means.

3. Apparatus as set forth in claim 2 wherein said mounting means is a movable carrier means.

4. Apparatus as set forth in claim 2 wherein said piston-cylinder means comprises an inner cylinder and an outer cylinder fixed with respect to the inner cylinder, wherein said tool mounting means is provided on the outer cylinder, wherein the piston of said piston-cylinder means is arranged stationarily with respect to the mounting means by way of the piston rod, and wherein said support means is lockable with respect to said mounting means.

5. Apparatus as set forth in claim 2 wherein said piston-cylinder means has a linear characteristic.

6. Apparatus as set forth in claim 2 wherein said piston-cylinder means has an outer cylinder, an inner cylinder therewithin, and an inner piston and piston rod assembly in said inner cylinder, wherein an axially movable separating piston is disposed between said inner and said outer cylinder thereby to divide the space between said inner and outer cylinders into two chambers, one said chamber being filled with hydraulic fluid and communicating with a chamber which is defined in said inner cylinder by said inner piston therein and which is also filled with hydraulic fluid, the other chamber of said two chambers in said outer cylinder being filled with a compressed gas, and the other chamber defined in said inner cylinder by said inner piston having atmospheric pressure therein.

7. Apparatus as set forth in claim 6 wherein said piston rod is removable from said piston-cylinder means.

8. Apparatus as set forth in claim 7 wherein said piston rod is guided in its cylinder by a rod guide means removably disposed in said cylinder, whereby said piston rod and said rod guide means are removable from the piston-cylinder means.

9. Apparatus as set forth in claim 7 wherein the relationship between the diameter of the piston rod and the inside diameter of said cylinder is adjustable.

10. Apparatus as set forth in claim 7 wherein an abutment means for limiting axial extension movement of said piston-cylinder means is secured to said cylinder.

11. Apparatus as set forth in claim 4 wherein said support means is in the form of a clamping tube means disposed around said outer cylinder, and wherein said outer cylinder is axially displaceable within said tube.

12. Apparatus as set forth in claim 11 wherein said tube comprises a circular casing capable of being clamped to the outer surface of said outer cylinder.

13. Apparatus as set forth in claim 12 comprising a clamping chuck means for clamping said tube to said piston-cylinder means.

14. Apparatus as set forth in claim 13 wherein said chuck means is pneumatically operable.

15. Apparatus as set forth in claim 11 wherein said tube is of polygonal cross-section and further comprising torsion bar means connecting said tool mounting means to said tube while permitting movement of said tool mounting means axially of said tube.

16. Apparatus as set forth in claim 1 wherein said mounting means comprises a movable carriage including pneumatically operable carriage-arresting means.

17. Apparatus as set forth in claim 1 wherein said mounting means comprises a movable carriage adapted to move on a floor surface, and further comprising a pneumatically operable lifting means for lifting said carriage from said floor thereby to arrest said carriage means.

18. Apparatus as set forth in claim 17 wherein said carriage includes means for mounting said tool for vertical and horizontal displacement and pivotal motion through 360°.

19. Apparatus as set forth in claim 18 wherein said carriage comprises a guide arrangement movably carrying a slide means adapted to support said tool for movement thereof relative to said slide means.

20. Apparatus as set forth in claim 19 wherein said carriage has first and second clampable tubes each carrying and clampable on a respective hydro-pneumatic piston-cylinder means for said vertical and horizontal movement of said tool, each of said piston-cylinder means comprising an outer cylinder with means for securing the tool thereto, and means for clamping the associated tube on said outer cylinder under a pneumatic control action.

21. Apparatus as set forth in claim 20 wherein said slide means is secured to said outer cylinders of said piston-cylinder means associated with said first and second tubes.

22. Apparatus as set forth in claim 20 wherein each said piston-cylinder means has a linear characteristic.

23. Apparatus as set forth in claim 20 wherein each said piston-cylinder means has an outer cylinder, an inner cylinder therewithin, and an inner piston and piston rod assembly in said inner cylinder, wherein an axially movable separating piston is disposed between said inner and said outer cylinder thereby to divide the space between said inner and outer cylinders into two chambers, one said chamber being filled with hydraulic fluid and communicating with a chamber which is defined in said inner cylinder by said inner piston therein and which is also filled with hydraulic fluid, the other chamber of said two chambers in said outer cylinder being filled with a compressed gas, and the other chamber defined in said inner cylinder by said inner piston having atmospheric pressure therein.

24. Apparatus as set forth in claim 20 wherein each said piston rod is removable from said piston-cylinder means.

25. Apparatus as set forth in claim 20 wherein each said piston-cylnder means comprises a piston rod which is guided in its cylinder by guide means removably disposed in said cylinder, whereby said piston rod and said rod guide means are removable from the piston-cylinder means.

26. Apparatus as set forth in claim 20 wherein, in respect of each said piston-cylinder means, the relationship between the diameter of the piston rod and the inside diameter of said cylinder is adjustable.

27. Apparatus as set forth in claim 20 wherein an abutment means for limiting the axial extension movement of said cylinder of each said piston-cylinder means is secured to the respective cylinder.

28. Apparatus as set forth in claim 20 wherein the cylinder of each said piston-cylinder means is surrounded by a clampable tube providing said support means, said cylinder being axially displaceable within the respective tube.

29. Apparatus as set forth in claim 28 wherein each said tube is of round cross-section and is capable of force-locking engagement with the outer surface of said respective cylinder.

30. Apparatus as set forth in claim 17 wherein said carriage carries a pneumatically lockable cylinder means adapted to provide pivotal movement of said tool.

31. Apparatus as set forth in claim 30 including a tool which is pneumatically operable.

32. Apparatus as set forth in claim 31 wherein said tool is a pneumatically operable driver means.

33. Apparatus as set forth in claim 3 further including sequential control means for sequential control of means for locking the movable carrier means before actuation of said tool.

34. Apparatus as set forth in claim 33 wherein said sequential control means is a pneumatic control means including a valve which comprises a valve body providing a bore slidably receiving a valve spool, and first, second and third chambers which adjoin each other and through which the bore extends, the valve spool comprising lands and grooves therebetween, the valve spool being displaceable axially in said chambers, the valve body further comprising a pressure medium inlet means communicating with the middle one of the chambers, and first and second pressure medium outlet means communicating with respective ones of the other chambers, one said outlet means also being in communication with the tool and the other also being in communication with said carriage locking means.

35. Apparatus as set forth in claim 33 wherein sealing means are disposed axially outwardly of the outer chambers and wherein regions of said valve bore which are disposed outside of said sealing means are connected to a vent port.

36. Apparatus as set forth in claim 34 wherein said valve spool is manually actuable.

37. A balancer for compensating for the weight of a manually guided tool comprising:

(a) a mounting means;

(b) a hydropneumatic piston-cylinder means for balancing said tool weight comprising:

a first cylinder;

a second cylinder disposed coaxially within the first cylinder;

a piston disposed within the second cylinder and forming first and second chambers therein and fixed with respect to the mounting means, whereby the first and second cylinders are axially displaceable relative to the mounting means;

a separating piston disposed freely slidably in the space between the first and second cylinders and dividing said space into first and second chambers, one said chamber being filled with compressed gas and the other said chamber being filled with hydraulic fluid, and duct means communicating said other chamber with the chamber in said second cylinder, which is towards said mounting means;

(c) means on said first cylinder for mounting a said tool thereto; and (d) a rigid bracing means having a first portion operably connected to said mounting means and a second portion connected to said first cylinder whereby forces produced by said tool in operation thereof are transmitted to said mounting means by said bracing means.

38. A balancer as set forth in claim 37 wherein said mounting means is a carriage.

39. A balancer as set forth in claim 37 wherein said bracer means comprises a tube carried by said mounting means, said first cylinder being slidably carried in the tube, and means for clamping said tube to said first cylinder to fix the length of said bracing means when said tool is in its desired operation position.

40. A balancer as set forth in claim 37 wherein said bracer means comprises a tube carried by said mounting means, said first cylinder being slidably carried in the tube, and a rigid bar assembly having a first end non-rotatably but axially slidably connected to said tube and a second end connected to said tool mounting means.

* * * * *